US006126387A

United States Patent [19]

Yoshida et al.

[11] Patent Number: 6,126,387

[45] Date of Patent: Oct. 3, 2000

[54] FUEL PUMP HAVING LOW OPERATING NOISE

[75] Inventors: Shigeru Yoshida; Yoshihiro Takami; Masaru Matsuda, all of Obu, Japan

[73] Assignee: Aisan Kogyo Kabushiki Kaisha, Obu, Japan

[21] Appl. No.: 09/147,691

[22] PCT Filed: Aug. 21, 1997

[86] PCT No.: PCT/JP97/02915

§ 371 Date: May 5, 1999

§ 102(e) Date: May 5, 1999

[87] PCT Pub. No.: WO98/09082

PCT Pub. Date: Mar. 5, 1998

[30] Foreign Application Priority Data

Aug. 26, 1996 [JP] Japan ..... 8-223668

[51] Int. Cl.[7] ..... F04D 5/00

[52] U.S. Cl. ..... 415/55.3; 415/55.4

[58] Field of Search ..... 415/55.1, 55.2, 415/55.3, 55.4, 119, 208.1

[56] References Cited

FOREIGN PATENT DOCUMENTS 55-32909 3/1980 Japan .
60-173390 9/1985 Japan .
2215995 8/1990 Japan .

OTHER PUBLICATIONS

"Noise & Vibrations" (first volume), Corona Publishing Co., Japanese Acoustics Association, Sep. 20, 1983, p. 46, Fig. 2–17.

"Sound and Sound Waves," Shokabo Publishing Co., Kohashi Yutaka, Apr. 25, 1984 (14th edition), p. 201, Fig. 13–3.

*Primary Examiner*—Edward K. Look
*Assistant Examiner*—Rhonda Barton
*Attorney, Agent, or Firm*—Dennison, Scheiner, Schultz & Wakeman

[57] ABSTRACT

A pump housing PH surrounding an impeller 21 comprises an inlet port 19 and an outlet port 20 disposed in a spaced-apart relationship from each other in a direction of rotation of the impeller 21, a pump passage 23 corresponding to vane grooves 22 of the impeller 21 and extending from the inlet port 19 to the outlet port 20 along the direction of the impeller rotation, and a partition 25 for partitioning between the outlet port 20 and the inlet port 19 along the direction of the impeller rotation. A passage-communicating portion 29 for communication between the inlet port 19 and the pump passage 23 is offset from the partition 25 in the direction of the impeller rotation, and a passage-enlarged portion 30 is provided between the partition 25 and the passage-communicating portion 29.

11 Claims, 17 Drawing Sheets

FIG. 1
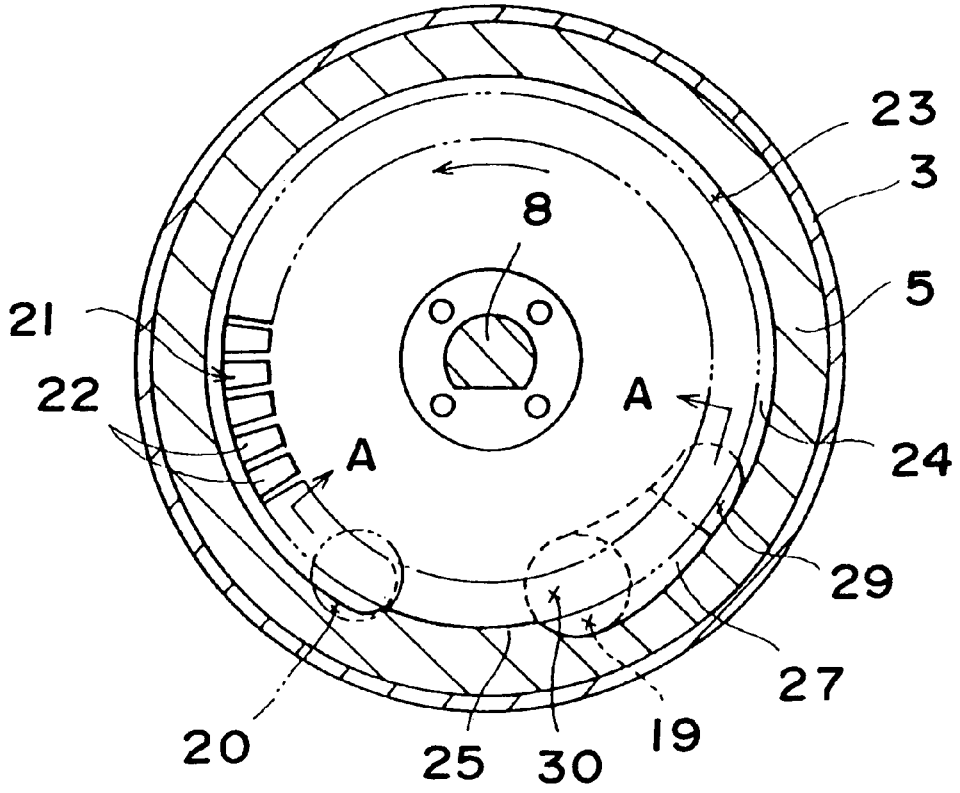
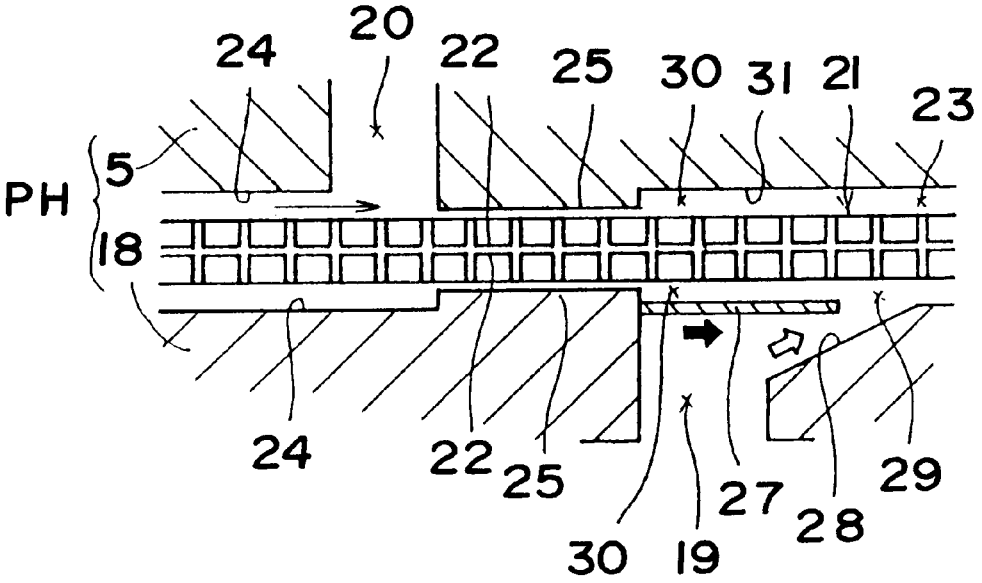
FIG. 2

FIG. 3
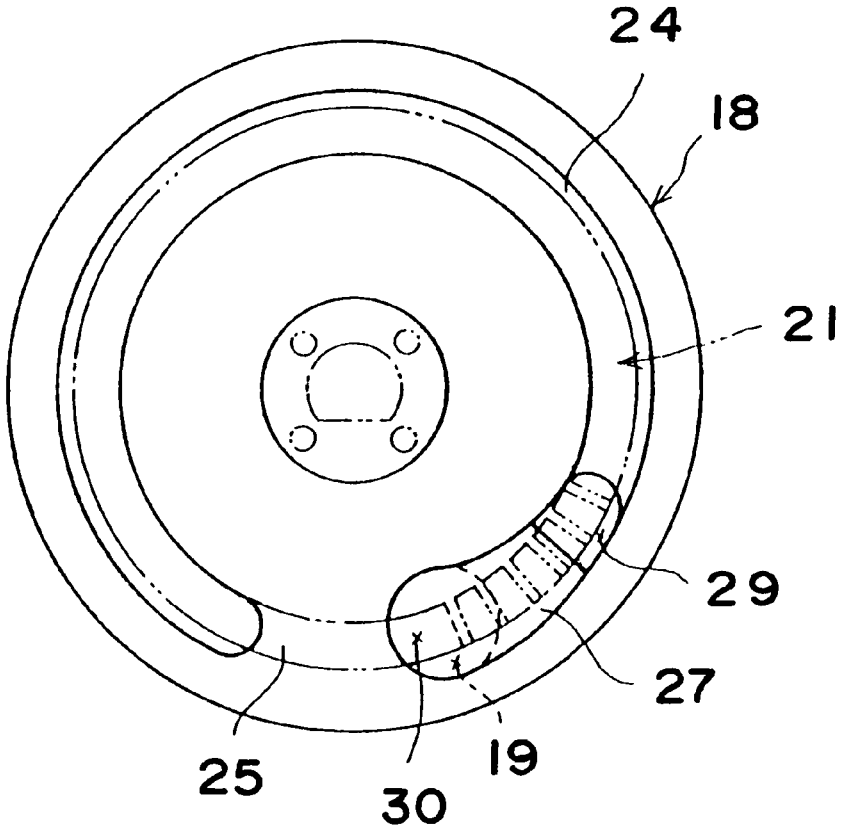
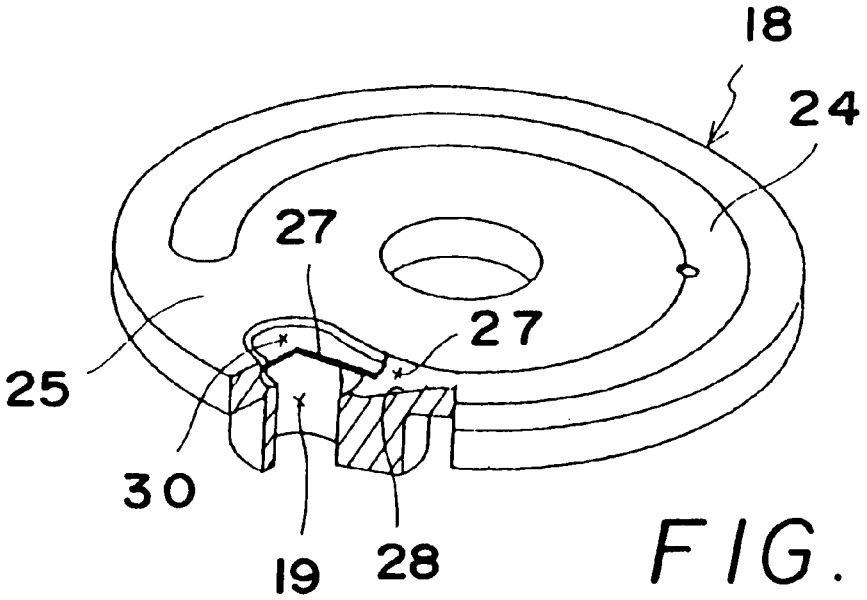
FIG. 4

FIG. 8
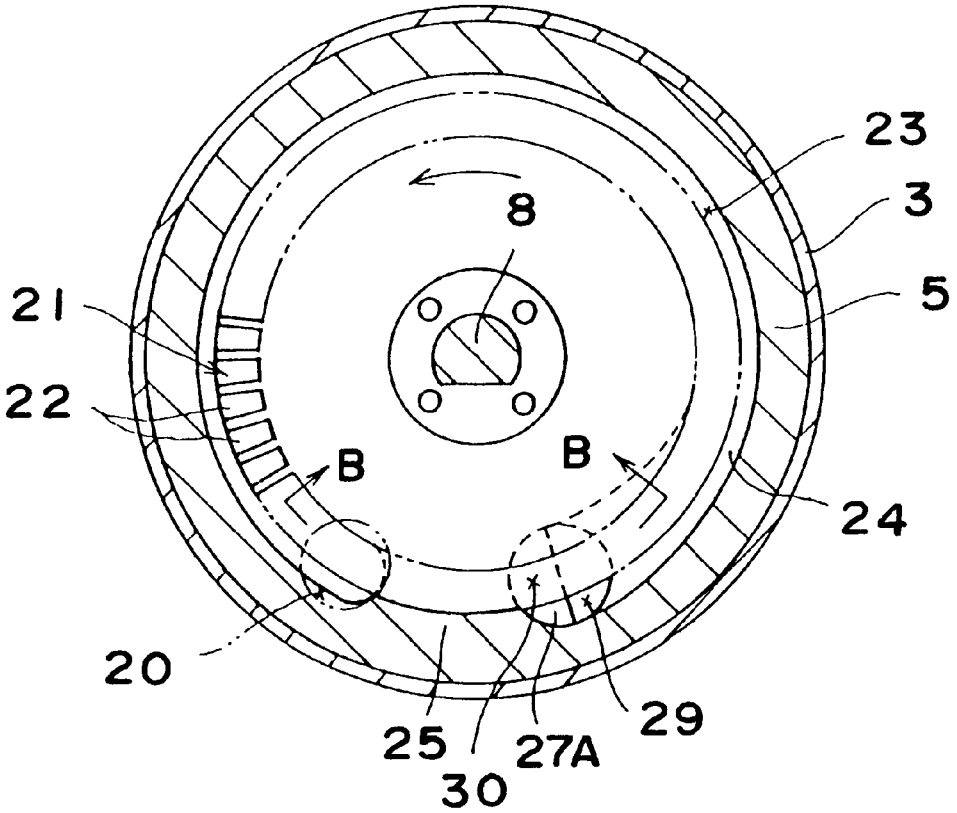
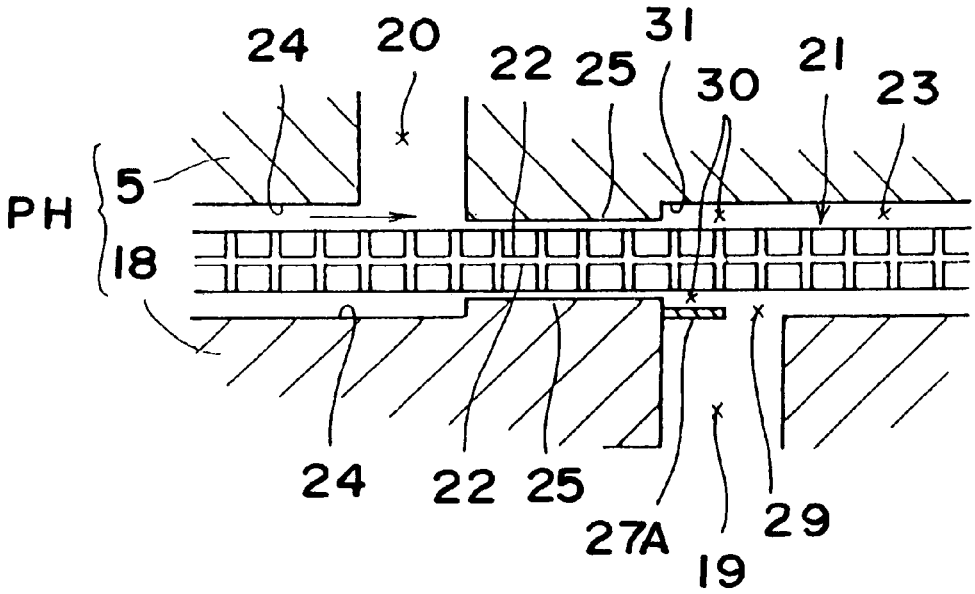
FIG. 9

FIG. 10
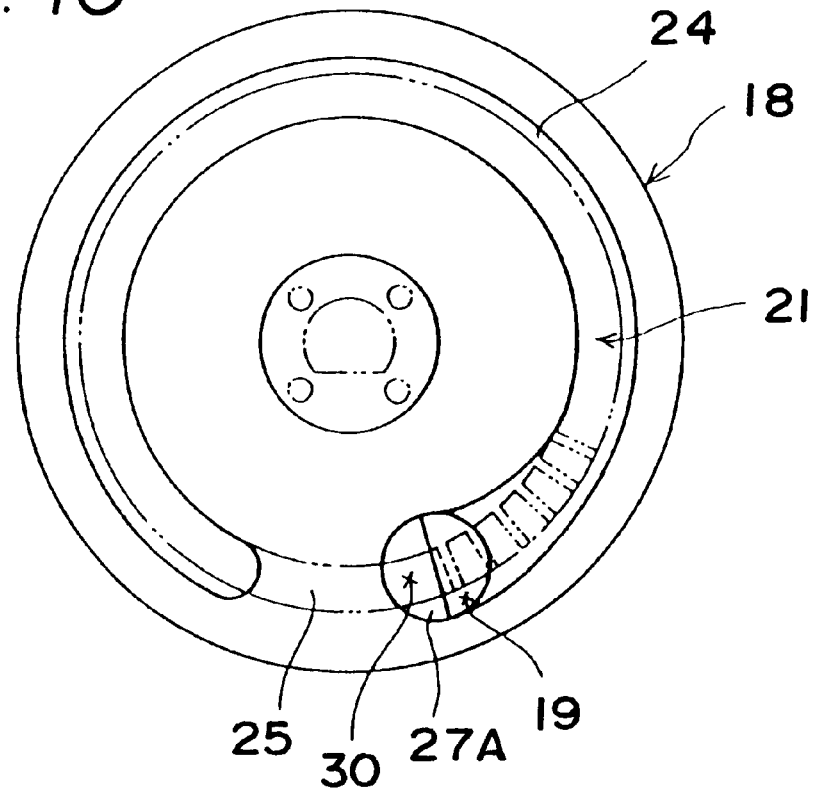
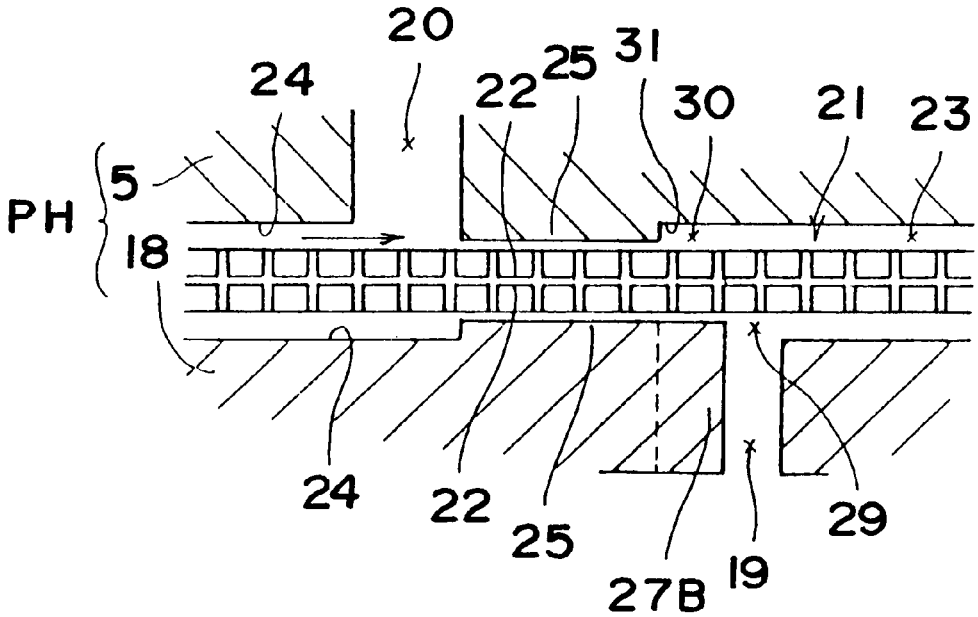
FIG. 11

FIG. 14
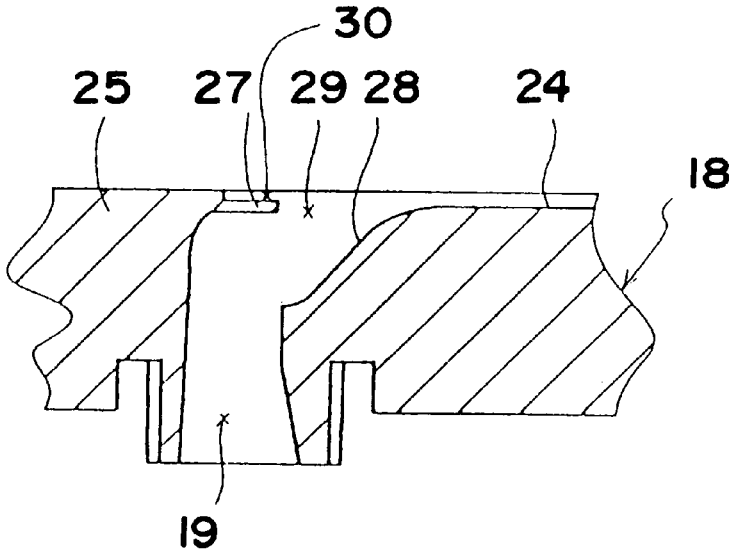
FIG. 15(a)
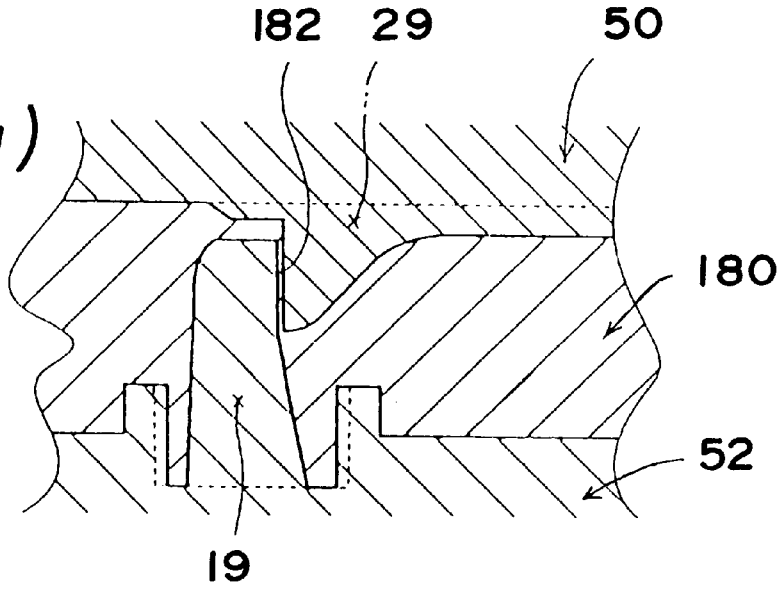
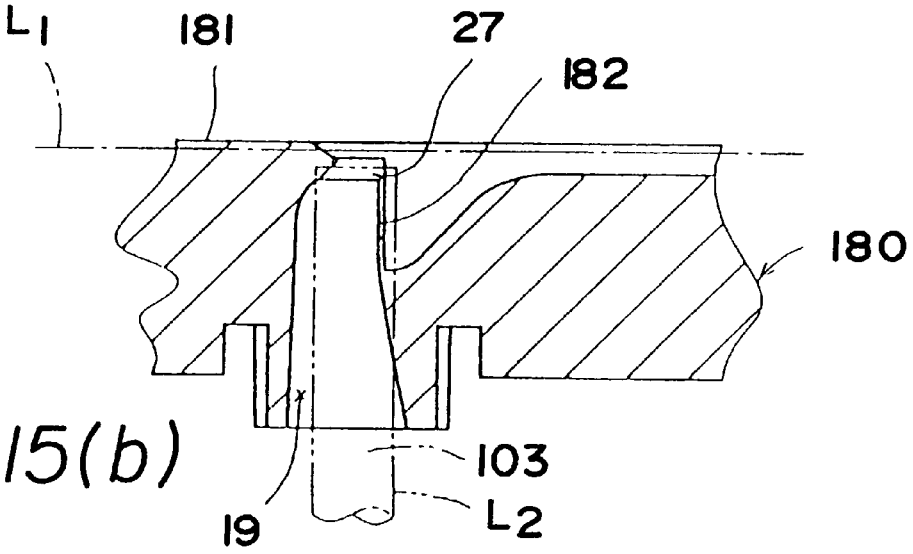
FIG. 15(b)

FIG. 16
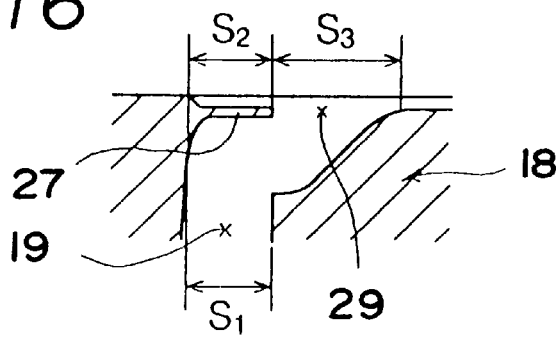
FIG. 17(a)
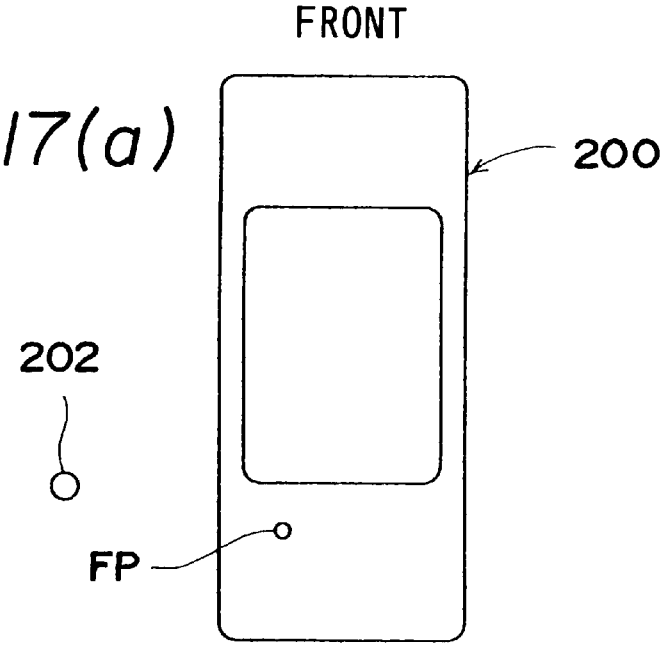
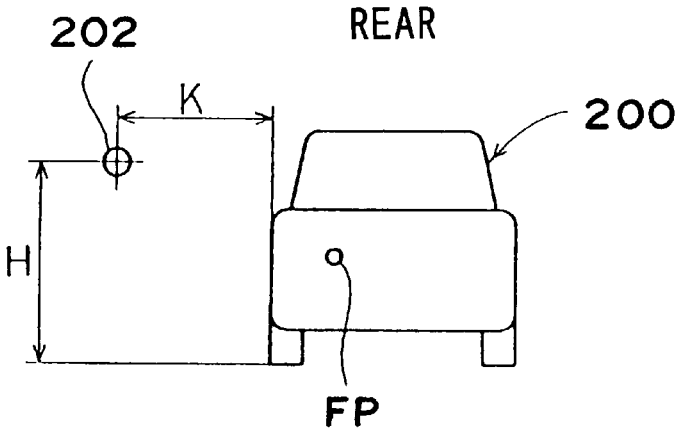
FIG. 17(b)

FIG. 25
PRIOR ART
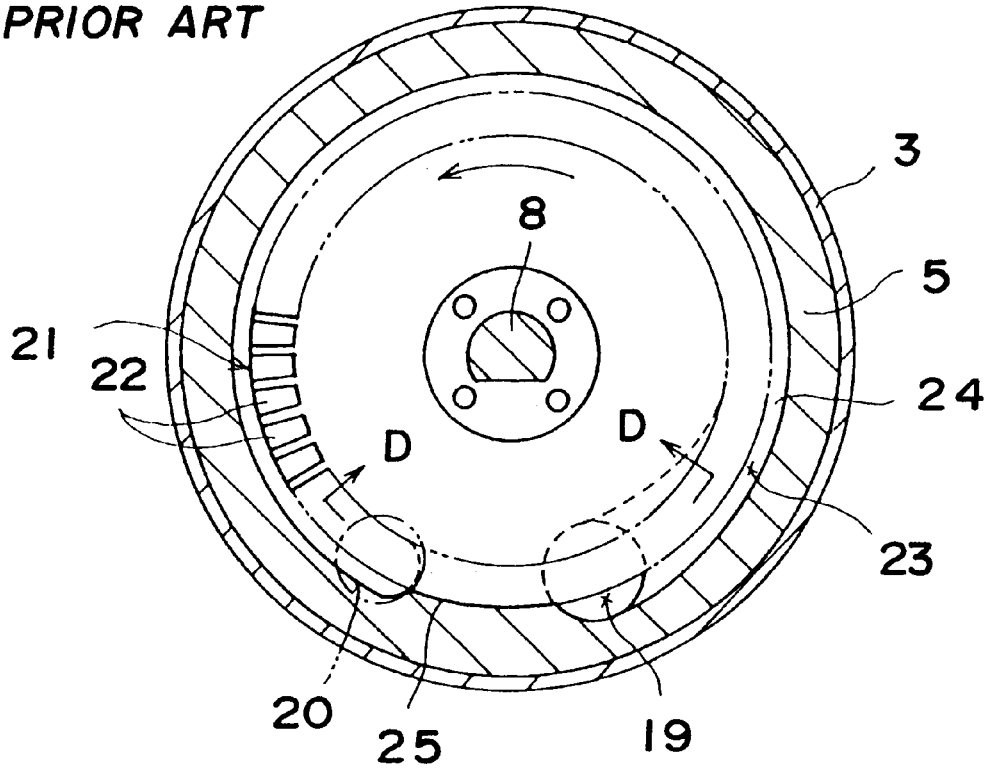
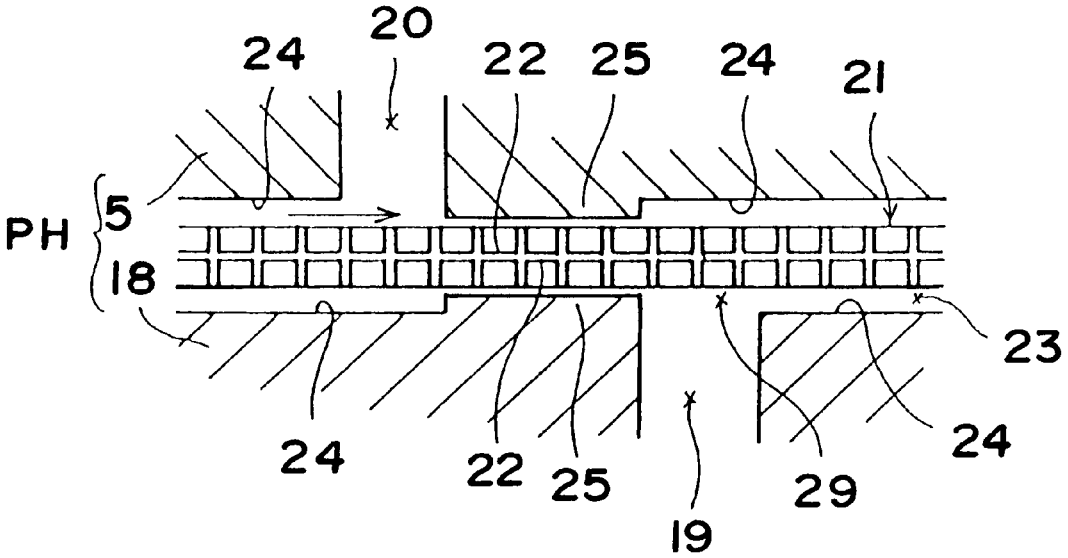
FIG. 26
PRIOR ART

FIG. 28
PRIOR ART
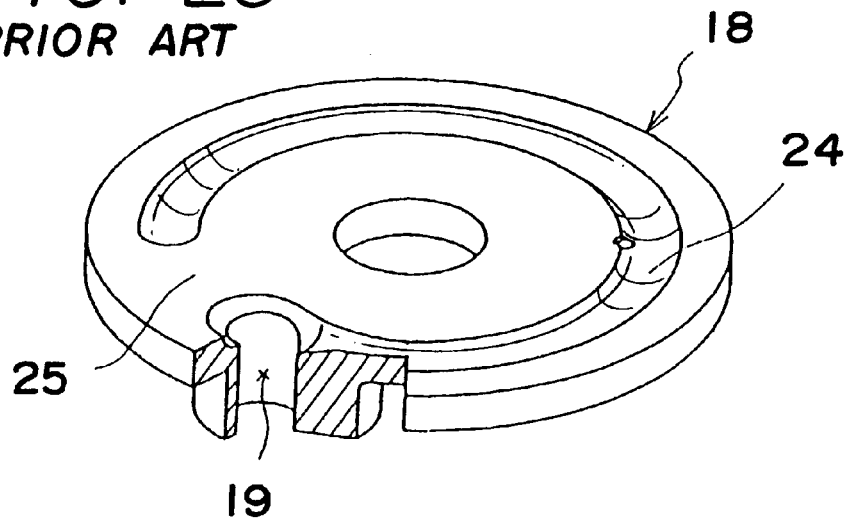
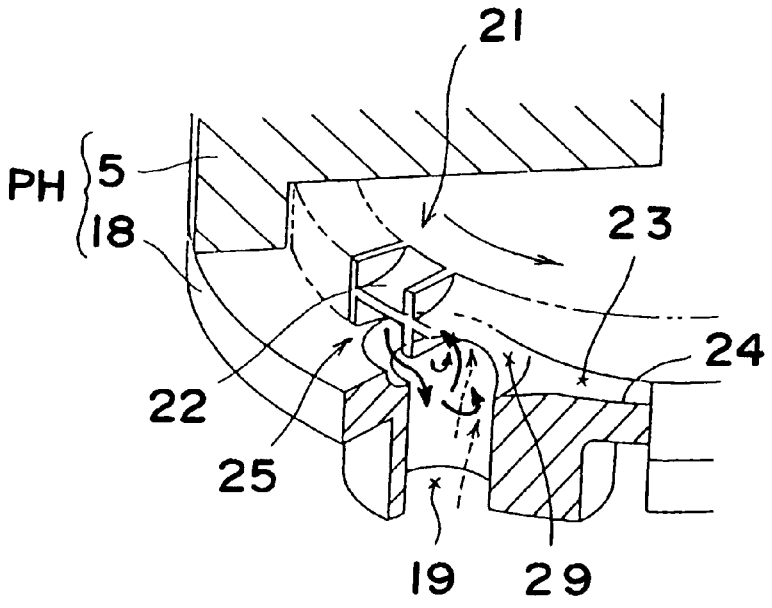
FIG. 29
PRIOR ART

FUEL PUMP HAVING LOW OPERATING NOISE

TECHNICAL FIELD

The present invention relates generally to fuel pumps used for vehicles, and more particularly, to fuel pumps improved so that pump-operating noise may be reduced.

TECHNICAL BACKGROUND

An example of a known fuel pump will be described with reference to FIGS. 24 to 29. As viewed in FIG. 24 in vertical-section, a fuel pump is disposed within a fuel tank (not shown) of a vehicle and comprises a motor section 1 and a pump section 2 assembled at an upper part and at a lower part, respectively, within a cylindrical motor housing 3.

In the motor section 1, a motor cover 4 is mounted at an upper end of the motor housing 3, and a pump cover 5 is mounted at a lower end of the motor housing 3. A motor chamber 6 is formed between the motor cover 4 and the pump cover 5 within the motor housing 3. In the motor chamber 6, an armature 7 is disposed having a commutator 12 on its top end. Upper and lower ends of a shaft 8 of the armature 7 are rotatably supported by the motor cover 4 and the pump cover 5 via bearings 9 and 10, respectively. A pair of magnets 11 is fixed on an inside surface of the motor housing 3. A brush 13 is disposed within the motor cover 4 via a spring 14 so as to slidably contact the commutator 12 of the armature 7. The spring 14 biases the brush 13 to press the commutator 12. The brush 13 is connected via a chalk coil 15 to an outside connecting terminal (not shown).

The motor cover 4 has a discharge port 16 with a check valve 17 incorporated therein. The discharge port 16 is connected to a fuel supply line FL that leads to a fuel injector (not shown) of a vehicle engine.

In the pump section 2, a pump body 18 is assembled with the pump cover 5. The pump body 18 is secured by caulking the lower end of the motor housing 3. A pump housing PH is constructed from the pump body 18 and the pump cover 5 so as to surround an impeller 21 as will be described later. The pump body 18 has a hollow cylindrical axial inlet port 19 therethrough. The pump cover 5 has a hollow cylindrical axial outlet port 20 therethrough. The inlet port 19 and the outlet port 20 in FIG. 24 are viewed as they are substantially coaxial with each other, but are in fact disposed in a spaced-apart relationship from each other in a direction of rotation of the impeller 21. This construction is best shown in FIGS. 25 and 26, which are a cross-sectional view taken along line C—C of FIG. 24 and an exploded sectional view taken along line D—D of FIG. 25, respectively.

The impeller 21 with a disc-like shape has a plurality of vane grooves 22 on opposite axial ends of the impeller 21 along an outer circumference thereof and is rotatably disposed between the pump cover 5 and the pump body 18. The impeller 21 is fitted onto the shaft 8 of the armature 7 as shown in FIGS. 24 and 25. As shown in FIGS. 25 and 26, the pump cover 5 and the pump body 18 are provided with respective flow channels 24 corresponding to the vane grooves 22 of the impeller 21. Both of the flow channels 24 are symmetrically placed in a vertical manner and together form a pump passage 23 extending from the inlet port 19 to the outlet port 20 along the direction of the impeller rotation. The pump cover 5 and the pump body 18 have respective partitions 25 extending from the outlet port 20 to the inlet port 19 in the direction of the impeller rotation for partitioning these two ports. The pump body 18 is shown in FIG. 27 in plan view and in FIG. 28 in a perspective partial cutaway view.

In this fuel pump, the shaft 8 of the armature 7 rotates by supplying electric current to the motor section 1 and rotates the impeller 21 in a counterclockwise direction as shown by a curved arrow in FIG. 25. As a result of this rotation, fuel stored in the fuel tank (not shown) is drawn through the inlet port 19. The drawn fuel is pressurized when passing through the pump passage 23, enters the motor chamber 6 through the outlet port 20, and is discharged through the discharge port 16 to the fuel supply line FL.

Another example of a known fuel pump is disclosed in Japanese Laid-Open Patent Publication 2-215995.

SUMMARY OF THE INVENTION

In the above-described known fuel pump, as shown in FIG. 26, a passage-communicating portion 29 for communication between the inlet port 19 and the pump passage 23 directly abuts the partition 25. Further, the fuel in the fuel supply line FL is normally in a pressurized state. Therefore, after flowing through the outlet port 20, the fuel is trapped under high pressure between the vane grooves 22 and the partition 25 in the rotating impeller 21. As the impeller 21 rotates, the vane grooves 22 having the trapped high-pressure fuel pass through the partition 25, and upon reaching the passage-communicating portion 29, the trapped high-pressure fuel is forcibly discharged through the passage-communicating portion 29. As a result, as shown in FIG. 29, the high-pressure fuel (shown by solid line arrows) flows back into the inlet port 19 and collides with newly drawn fuel (shown by dotted line arrows), thus generating turbulence around the passage-communicating portion 29. Generation of such turbulence increases impeller noise, thus yielding pump-operating noise.

In order to solve the above-described problems, the present invention provides a fuel pump in which turbulence caused by high-pressure fuel flowing back into an inlet port are eliminated, thereby reducing pump operating noise.

In a first aspect of the present invention, a partition for partitioning an inlet port and an outlet port is provided in a pump housing PH that surrounds an impeller having vane grooves on an outer circumference thereof. A passage-communicating portion for communication between the inlet port and a pump passage is offset from the partition in the direction of the impeller rotation. A passage-enlarged portion is provided between the partition and the offset passage-communicating portion such that the passage-enlarged portion has a flow passage area greater than a flow passage area narrowed by the partition.

According to the first aspect, as the impeller rotates, high-pressure fuel trapped within the vane grooves by the partition is discharged to the passage-enlarged portion before reaching the passage-communicating portion, so that the fuel-pressure is reduced. Therefore, a force that would cause the high-pressure fuel to flow back into the inlet port is reduced, thus prohibiting turbulence from occurring and further reducing pump-operating noise.

In a second aspect of the present invention, a shielding wall is provided between the inlet port and the passage-enlarged portion.

According to the second aspect, fuel drawn through the inlet port is introduced along the shielding wall to the passage-communicating portion. With this construction, the fuel drawn through the inlet port can smoothly mix with the decompressed fuel while flowing through the passage-enlarged portion. Therefore, pump-operating noise is further reduced.

In a third aspect of the present invention, a wall surface is formed opposite to the shielding wall in the passage-communicating portion so as to slant upward from the inlet port to the pump passage in the direction of the impeller rotation.

According to the third aspect, the fuel drawn through the inlet port flows more smoothly into the pump passage by passing along the slant surface.

In a fourth aspect of the present invention, an inlet-port-side surface of the shielding wall is formed to slant upward from the inlet port toward the passage-communicating portion in the direction of the impeller rotation.

According to this aspect, the fuel drawn through the inlet port flows more smoothly into the passage-communicating portion by passing along the slant surface of the shielding wall.

In a fifth aspect of the present invention, where $S_1$ is the flow passage area of the inlet port and $S_2$ is the shielding area of the shielding wall, the sizes of $S_1$ and $S_2$ are adjusted to satisfy the following relationship:

$$S_2/S_1>0.5.$$

According to this aspect, the pump-operating noise is suppressed to a level at which most people typically feel no discomfort.

In a sixth aspect of the present invention, two passage-enlarged portions are provided to axially face each end of the impeller.

According to the sixth aspect, when the high-pressure fuel is decompressed, fuel pressure is uniformly distributed to the opposite ends of the impeller, thus permitting smoother rotation of the impeller in comparison to the case in which the passage-enlarged portion is provided to face one end of the impeller.

In a seventh aspect of the present invention, a starting edge of a passage-enlarged portion provided axially on the same side of the impeller as the inlet port is offset from a starting edge of the opposite side passage-enlarged portion in the direction of the impeller rotation.

According to the seventh aspect, the high-pressure fuel is decompressed step-wise first in the opposite side passage-enlarged portion and then in the inlet-port-side passage-enlarged portion. Therefore, decompression of the high-pressure is more efficiently performed in comparison to a pump housing in which both-side starting edges of the enlarged portions are axially disposed at the same position of the impeller in which decompression of the high-pressure fuel begins simultaneously. In addition, in this embodiment, the pressure difference between the decompressed fuel and the fuel drawn through the inlet port (having negative pressure) is reduced, thus reducing the colliding force of the fuel from two different directions, and thereby efficiently reducing pump-operating noise.

In a eighth aspect of the present invention, the passage-enlarged portion is provided at a position radially outside of the inner periphery of the pump passage.

According to the eighth aspect, the passage-enlarged portion can be provided without reducing a sealing area of the pump housing PH relative to the impeller.

BRIEF DESCRIPTION OF THE DRAWINGS

FIG. 1 is a cross-sectional plan view showing a first embodiment of the present invention.

FIG. 2 is a developed sectional view taken along line A—A of FIG. 1.

FIG. 3 is a plan view of a pump body of the first embodiment.

FIG. 4 is a partial perspective view of the pump body.

FIG. 8 is a cross-sectional plan view showing a fourth embodiment of the present invention.

FIG. 9 is a developed sectional view taken along line B—B of FIG. 8.

FIG. 10 is a plan view of a pump body of the fourth embodiment.

FIG. 11 is a fragmentary sectional view showing a fifth embodiment of the present invention.

FIG. 14 is a sectional view showing a periphery of an inlet port of the pump body of the sixth embodiment.

FIG. 15(*a*) is a sectional view showing the pump body of FIG. 14 in the process of being constructed.

FIG. 15(*b*) is a sectional view showing a half-finished pump body of FIG. 14.

FIG. 16 is a sectional view showing the dimensional relationship between the inlet port and the shielding wall.

FIG. 17(*a*) is an explanatory view of a scheme for measuring noise levels showing a plan view of a vehicle used in the scheme.

FIG. 17(*b*) is a back elevation view of the vehicle.

FIG. 25 is a sectional view taken along line C—C of FIG. 24.

FIG. 26 is a developed sectional view taken along line D—D of FIG. 25.

FIG. 28 is a partially cutaway perspective view of the pump body.

FIG. 29 is an explanatory view showing fuel flows.

BEST MODES FOR CARRYING OUT THE INVENTION

Embodiment 1

Referring now to FIGS. 1 to 5, Embodiment 1 will be described. Embodiment 1 is a partial modification of a known device. Therefore, only the modified elements will be described hereinafter. Other elements that are the same as or substantially similar to those of the known device, and a description thereof will not be repeated. Like elements are given like reference numbers. This scheme will also be applied to the descriptions of Embodiments 2 to 11.

Figure 24:
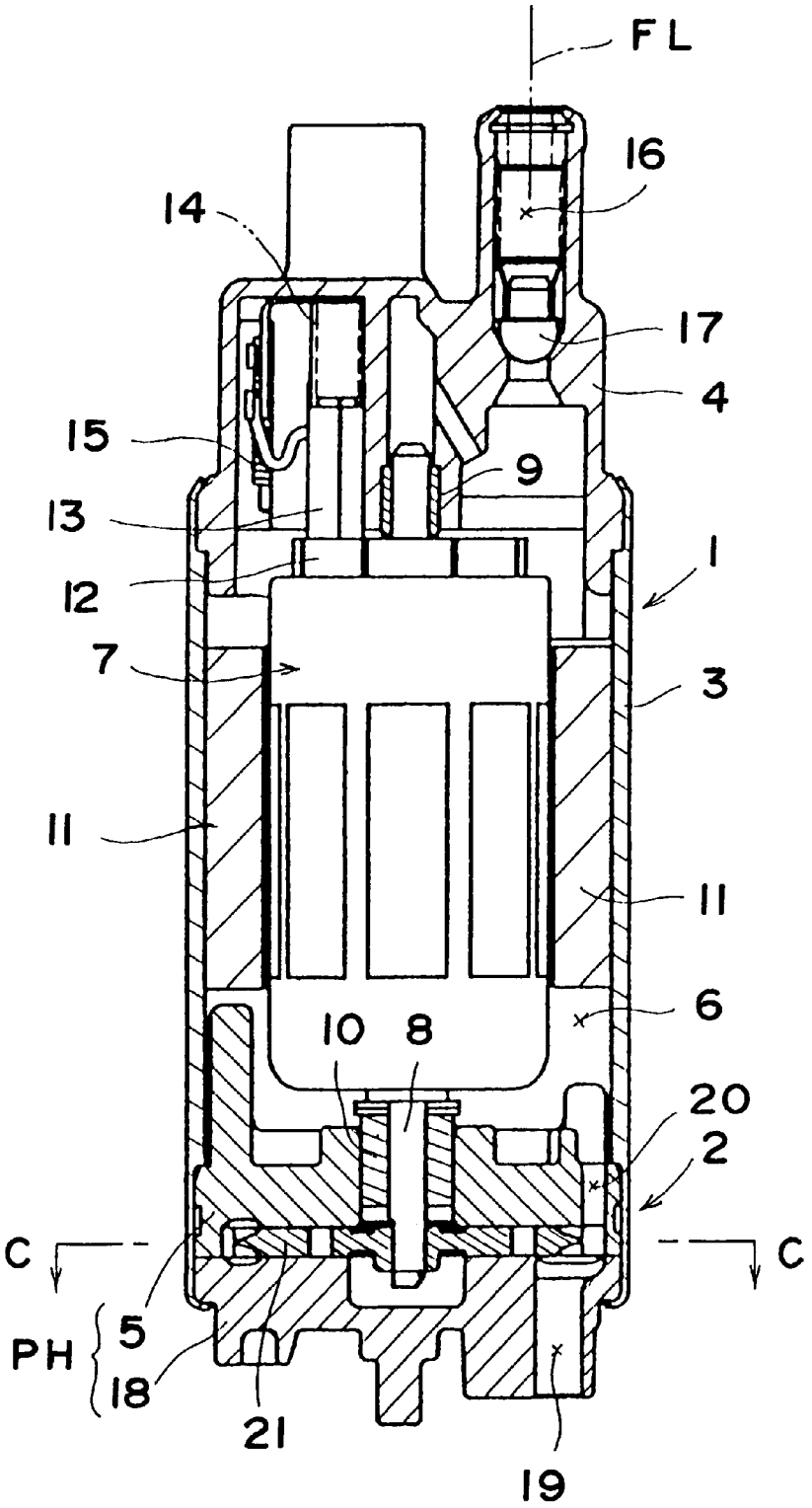
FIG. 24 PRIOR ART
FIG. 24 is a vertical sectional view of a known device.
Figure 27:
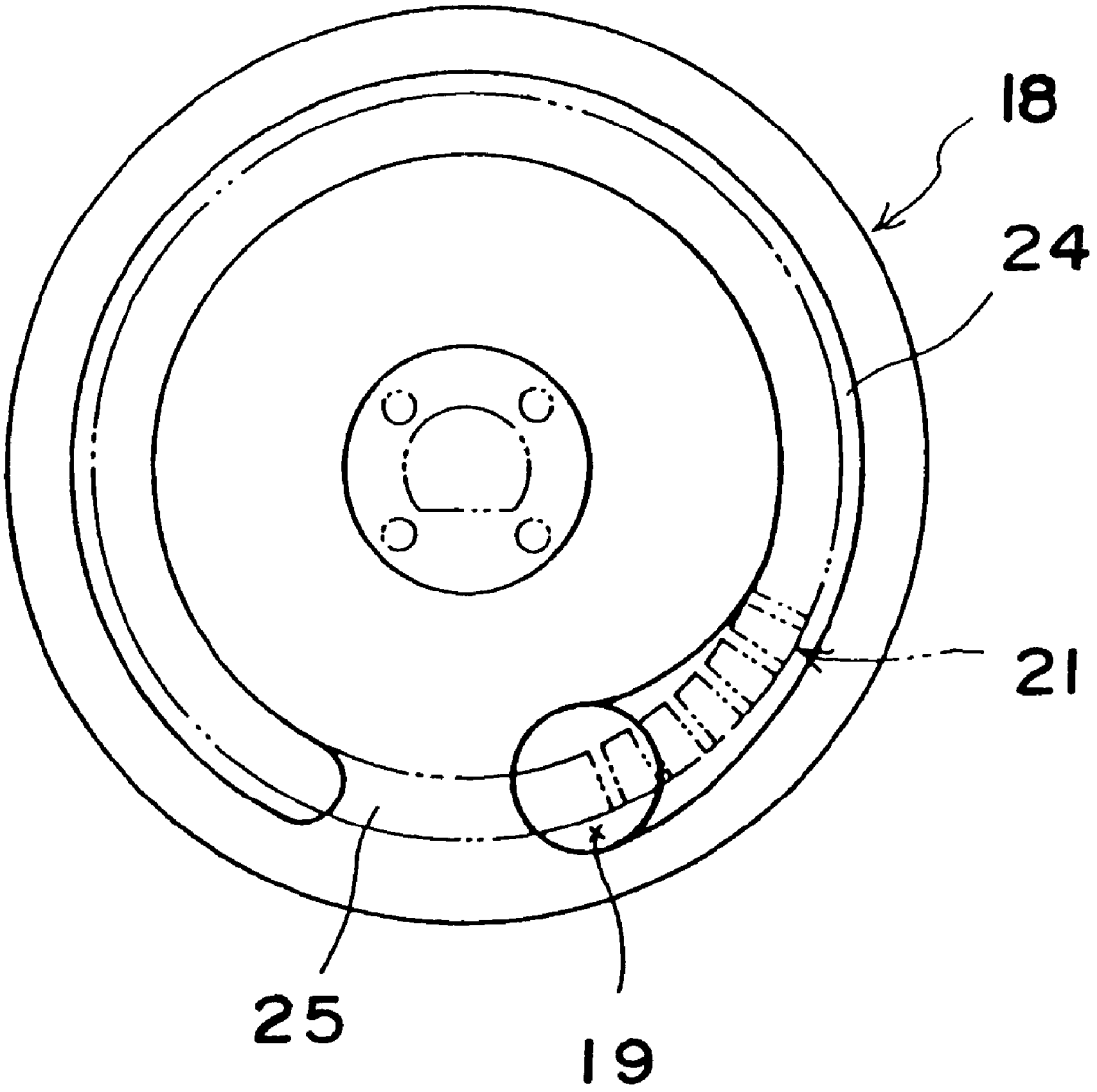
FIG. 27 PRIOR ART
FIG. 27 is a plan view of the pump body.

FIG. 1 is a cross-sectional plan view showing Embodiment 1 and corresponds to a sectional view taken along line C—C of FIG. 24. FIG. 2 shows a developed sectional view taken along line A—A of FIG. 1, and FIG. 3 shows a plan view of a pump body 18. FIG. 4 shows a perspective view of the pump body 18 with a part broken away. As shown in FIGS. 2 to 4, a plate-like shielding wall 27 is provided on a partition-side wall surface of the inlet port 19 to project in the direction of the impeller rotation.

By thus providing the shielding wall 27, a passage-communicating portion 29 for communication between the inlet port 19 and the pump passage 23 is offset from the partition 25 in the direction of the impeller rotation (in the right side direction in FIG. 2). The periphery of the shielding wall 27 abuts the wall surface of the inlet port 19 excluding that of the passage-communicating portion 29 (see FIG. 4). The shielding wall 27 is integrated with the pump body 18, although it may be assembled with the pump body 18 after both of the elements are formed separately.

As shown in FIG. 2, a passage-enlarged portion 30 is provided between the partition 25 and the passage-communicating portion 29 such that the passage-enlarged portion 30 has a flow passage area larger than that narrowed by the partition 25. The shielding wall 27 is mounted between the passage-enlarged portion 30 and the inlet port 19. In Embodiment 1, two passage-enlarged portions 30 are provided such that each portion axially faces each end of the impeller. Specifically, in the pump body 18, the shielding wall 27 is provided to have a stair-step shape relative to a sealing surface of the partition 25 (a surface facing the impeller 21, hereinafter simply referred to as "sealing surface"), where a body-side passage-enlarged portion 30 is formed to face a body-side axial end of the impeller 21 (the bottom surface of the impeller in FIG. 2). On the other hand, the pump cover 5 is provided with a recess 31 substantially coplanar with the flow channel 24 of the pump passage 23, where a cover-side passage-enlarged portion 30 is formed to face a cover-side axial end of the impeller 21 (the top surface of the impeller).

A wall surface, which faces the shielding wall 27 in the passage-communicating portion 29, is formed into a slant surface 28 that slants upward from the inlet port 19 toward the pump passage 23 in the direction of the impeller rotation. The pump cover 5 and the pump body 18 are die-cast from aluminum. The impeller 21 is made of a phenol resin.

According to the above-described fuel pump, as the impeller rotates, the high-pressure fuel trapped within the vane grooves 22 of the impeller 21 is discharged to the passage-enlarged portion 30 and is therefore decompressed before reaching the passage-communicating portion 29 of the pump passage 23. The fuel is decompressed in the passage-enlarged portion 30 when reaching the passage-communicating portion 29, thus reducing a force that would cause the high-pressure fuel to flow back into the inlet port 19. Therefore, the back-flow of the high-pressure fuel into the inlet port 19 is reduced, and prohibits turbulence from occurring, thus reducing pump-operating noise.

In addition, the fuel drawn through the inlet port 19 is introduced along the shielding wall 27 toward the passage-communicating portion 29 (see thick black arrow in FIG. 2), thereby smoothly mixing the decompressed fuel from the passage-enlarged portion 30 with the newly drawn fuel from the inlet port 19. As a result of the smooth confluence of the fuel, the fuel pump of Embodiment 1 has the advantages of prohibiting vapor lock from occurring and improving pump efficiency. Also, pump-operating noise is reduced.

Further, the fuel drawn through the inlet port 19 can flow more smoothly by flowing along the slant surface 28 which faces the shielding wall 27 (see thick white arrow in FIG. 2).

By disposing the body-side and the cover-side passage-enlarged portions 30 so as to face the respective axial ends of the impeller 21, decompressed fuel pressure can be uniformly distributed on the axial ends of the impeller 21, resulting in smooth rotation of the impeller 21. Embodiment 1 has the above-described advantage in comparison to Embodiments 2 and 3 (described below) in which one passage-enlarged portion 30 is provided to face one axial end of the impeller 21.

Figure 5:
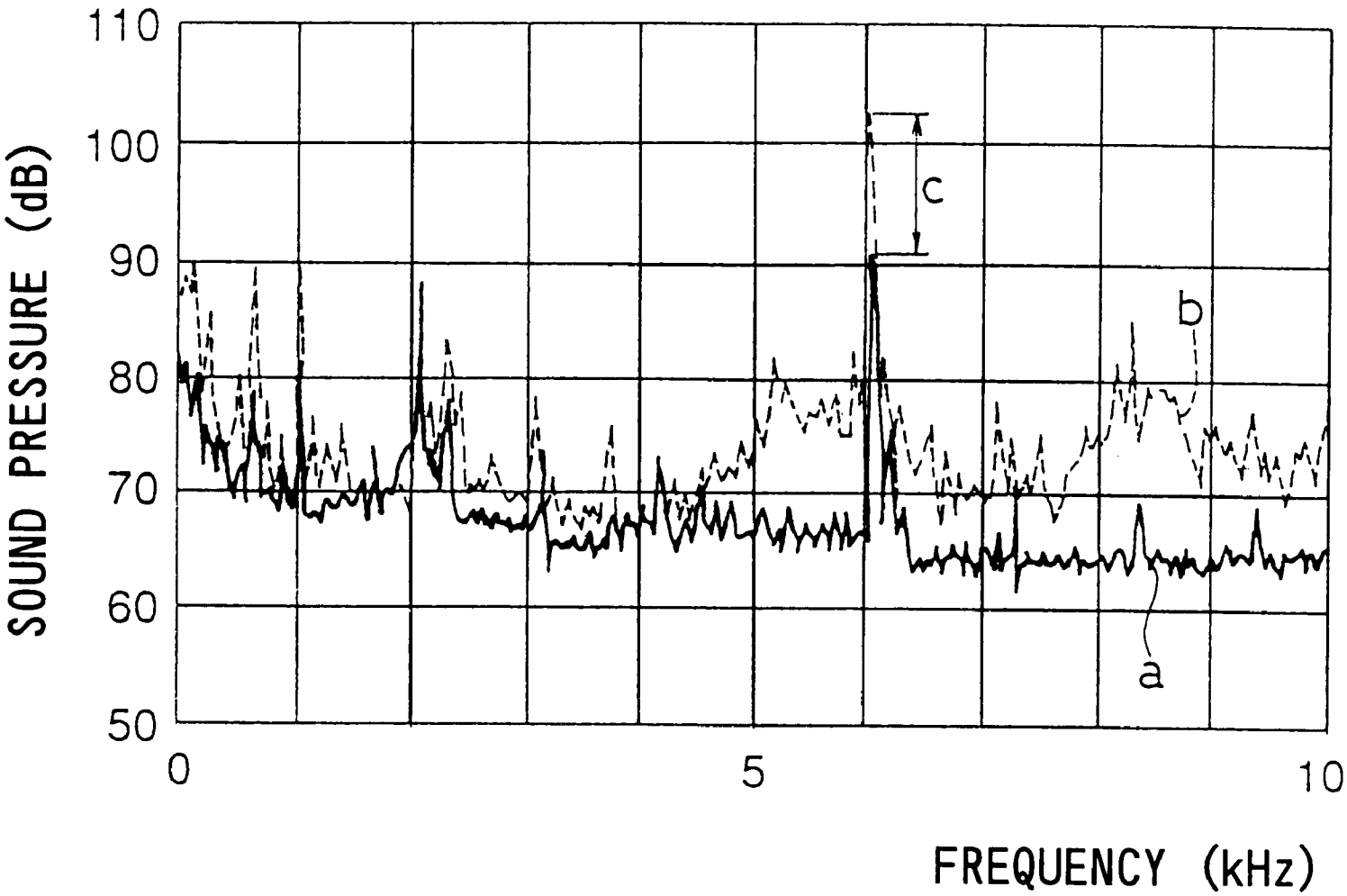
FIG. 5 shows characteristic curves of the relationship between frequency and sound pressure for the first embodiment and a known device.

FIG. 5 is a graph showing the result of measuring sound pressures or sounds emitted from fuel pumps of the first embodiment and of the known art, each pump being in liquid. In FIG. 5, the abscissa shows frequencies (kHz) and the ordinate shows sound (dB). Solid line a shows a sound wave-form of the fuel pump of Embodiment 1 and dotted line b shows a sound wave-form of the fuel pump of the known art. As should be apparent from FIG. 5, sounds are greatly reduced by the fuel pump of Embodiment 1 in comparison to the known fuel pump. In FIG. 5, sound reduction in frequency bands over 5 kHz shows the effect that pulsations are reduced. About a 12 dB reduction of the sound (shown by c in FIG. 5) around the 6.1 kHz frequency shows the effect that high-frequency sound is reduced. The above results were obtained when the fuel pumps were operated at an applied voltage of 14V and at a fuel discharge pressure of 216 kPa.

Embodiment 2

Figure 6:
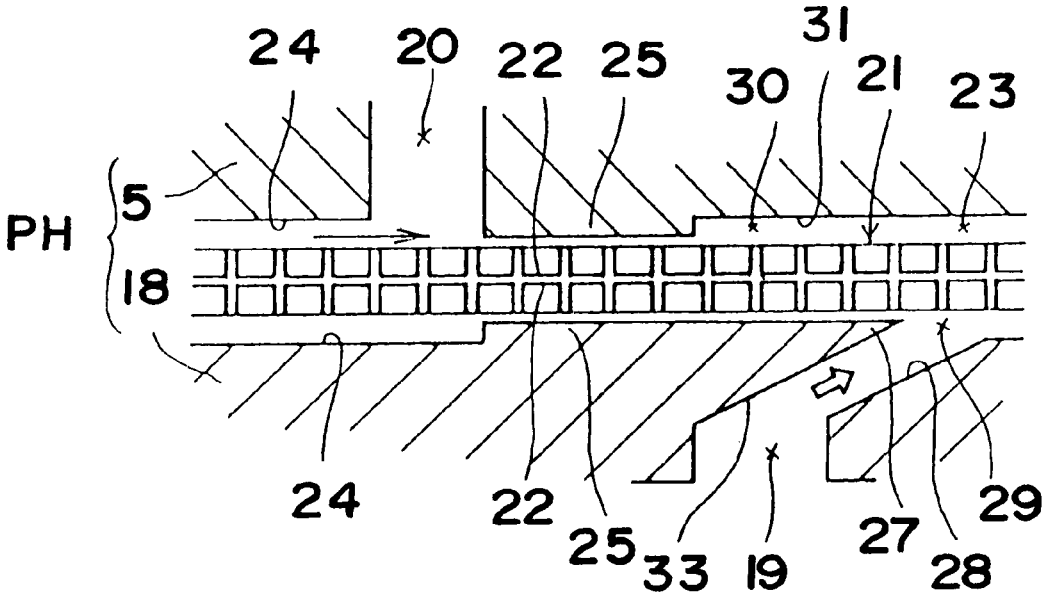
FIG. 6 is a fragmentary sectional view showing a second embodiment of the present invention.

Embodiment 2 will now be described with reference to FIG. 6 showing a fragmentary sectional view thereof. Embodiment 2 is a partial modification of Embodiment 1. In this embodiment, an inlet-port-side wall surface of the shielding wall 27 is formed into a slant surface 33 slanting upward from the inlet port toward the passage-communicating portion 29 in the direction of the impeller rotation. (This may be referred to as a slant surface of the shielding wall 27).

According to this embodiment, the fuel drawn through the inlet port 19 can be transferred more smoothly to the passage-communicating portion 29 by flowing along the slant surface 33 of the shielding wall 27 (see the thick white arrow in FIG. 6). As shown in FIG. 6, a shielding wall surface which faces the impeller 21 is coplanar with the sealing surface of the body-side partition 25. Therefore, in this embodiment, one passage-enlarged portion 30 is provided to start from the cover-side sealing surface which faces the cover-side axial end of the impeller 21.

Embodiment 3

Figure 7:
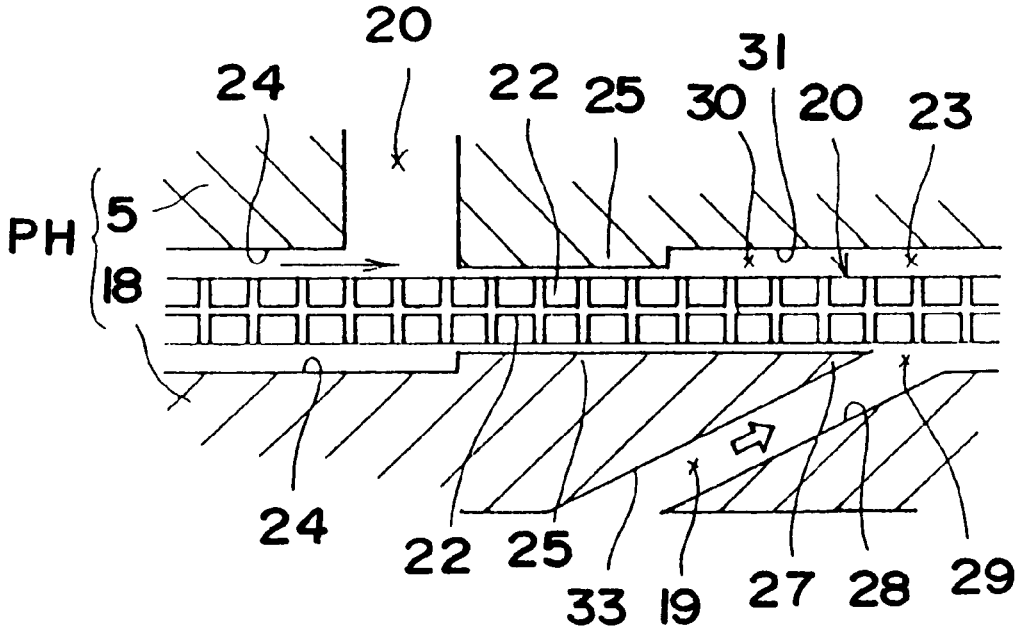
FIG. 7 is a fragmentary sectional view showing a third embodiment of the present invention.

Embodiment 3 will now be described with reference to FIG. 7 showing a fragmentary sectional view thereof. Embodiment 3 is a partial modification of Embodiment 2 (FIG. 6). In this embodiment, the slant surfaces 33 of the shielding wall 27 and the slant surface 28 that faces the shielding wall 27 extend linearly downward to the drawing portion (lowermost end in FIG. 7) of the inlet port 19.

Embodiment 4

Embodiment 4 will now be described with reference to FIGS. 8 to 10. Embodiment 4 is a partial modification of the known art. FIG. 8 is a cross-sectional plan view, FIG. 9 is a developed sectional view taken along line B—B of FIG. 8. FIG. 10 is a plan view of the pump body 18. As can be seen in FIGS. 9 and 10, a semicircular plate-like shielding wall 27A is provided to project in the direction of the impeller rotation from the partition-side wall surface of the inlet port 19 of the pump body 18. The shielding wall 27A is mounted in a stepping relationship with the sealing surface of the partition 25 (see FIGS. 8 and 9). In this embodiment, half of the inlet port 19 is shielded by the shielding wall 27A and the other half is not shielded and serves as the passage-communicating portion 29, at which the passage-enlarged portion 30 is formed facing the impeller 21.

According to this embodiment, by providing the semicircular plate-like shielding wall 27A in the inlet port 19 of the known pump body 18, not only the passage-communicating portion 29 can be offset but also the passage-enlarged portion 30 can be formed. As shown in FIG. 9, in the pump cover 5, a recess 31 of the flow channel 24 corresponding to the terminal end of the inlet port 19 serves as a cover-side passage-enlarged portion 30 which faces the cover-side axial end of the impeller 21.

Embodiment 5

Embodiment 5 will now be described with reference to FIG. 11 showing a fragmentary sectional view thereof. Embodiment 5 is a partial modification of the known art. In this embodiment, the inlet port 19 of the pump body 18 is formed to have a semi-circular cross-section such that half of the space of the known inlet port is filled extending from the partition-side. The half of the inlet port that is filled serves as shielding wall 27B.

According to this embodiment, similar to Embodiment 4, by providing only the shielding wall 27B in the inlet port 19 of the pump body 18 of the known art, not only the passage-communicating portion 29 can be offset but also the passage-enlarged portion 30 can be formed (on the cover side). In the pump cover 5, a recess 31 of the flow channel 24 corresponding to the terminal end of the inlet port 19 serves as the cover-side passage-enlarged portion 30 which faces the cover-side axial end of the impeller 21. In addition, a surface of the shielding wall 27B facing the impeller 21 is formed to be coplanar with the sealing surface of the body-side partition 25.

Embodiment 6

Embodiment 6 will now be described with reference to FIGS. 12 to 18. In Embodiment 6, a practical technique for constructing the pump body 18 is illustrated in FIGS. 15(*a*) and 15(*b*). As shown in section in FIG. 15(*a*), a half-finished product 180 of the pump body 18 is die-cast from aluminum using an upper-die 50 and a lower-die 52. The upper and the lower dies 50 and 52 are designed to form a clearance in order to avoid direct contact when closed. In the half-finished product 180, a thin film 182 is formed between the inlet port 19 and the passage-communicating portion 29 because the clearance is filled by a molten metal. When the molding is completed, the dies are opened and the half-finished product 180 is removed.

FIG. 15(*b*) shows a sectional view of the half-finished product in which an upper surface 181 of the half-finished product 180 is machined into a sealing surface as shown by one dotted and chain line $L_1$. The thin film 182 is cut out by machining the inlet port 19 with a drill 103 with a plane end as shown by two dotted and chain line $L_2$. Thus, the pump body 18 shown in FIGS. 12 to 14 is completed.

Figure 12:
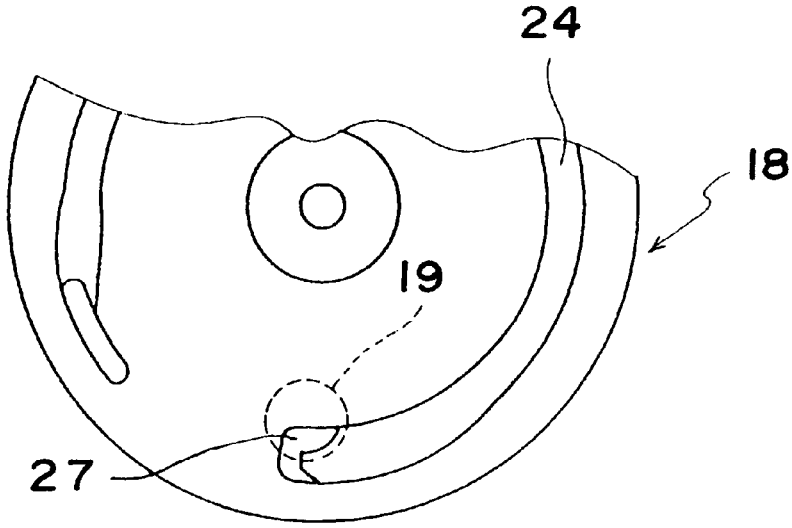
FIG. 12 is a partial plan view of a pump body showing a sixth embodiment of the present invention.
Figure 13:
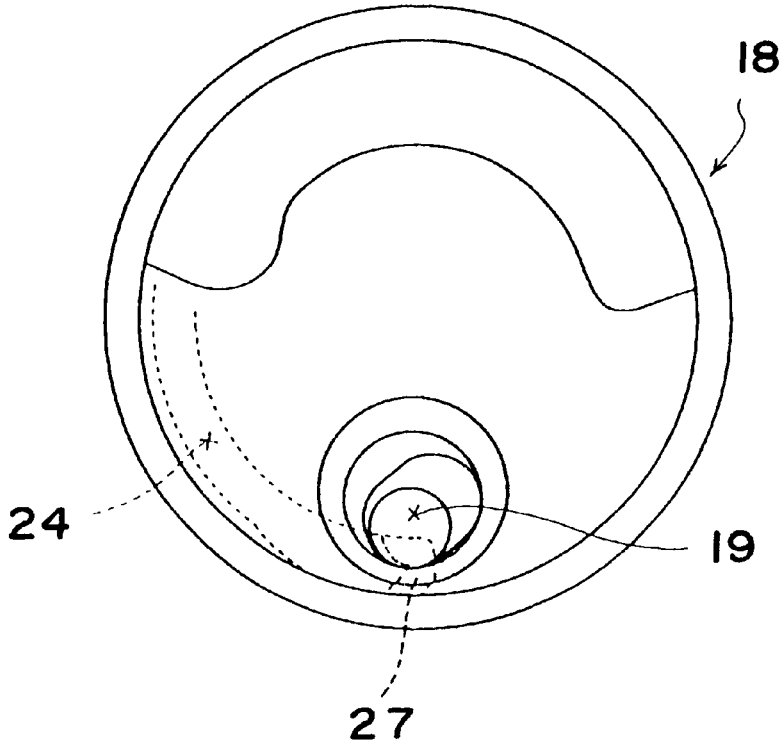
FIG. 13 is a bottom view of the pump body of the sixth embodiment.

FIG. 12 is a partial plan view of the pump body 18, FIG. 13 is a bottom end view thereof, and FIG. 14 is a sectional view showing a periphery of the inlet port 19. In FIGS. 12 to 14, the same numbers are assigned to those elements that are the same as or correspond to the elements of Embodiment 1.

A test was conducted to measure noise levels from a vehicle that utilizes a fuel pump with a pump body of this embodiment therein. The results of the test will be described hereinafter. FIG. 16 is a sectional view illustrating the dimensional relationship between the inlet port 19 and the shielding wall 27. A multiple number of pump bodies 18 were prepared, in which flow passage area $S_1$ of the inlet port 19 and flow passage area $S_3$ of the passage-communicating portion 29 were set as constants and shielding area $S_2$ of the shielding wall 27 was variously changed. Noise emitted from the vehicle was measured. FIG. 17(*a*) is a plan view of the test vehicle 200 and FIG. 17(*b*) is a rear side elevation view thereof. Noise levels emitted from the fuel pump were measured by a microphone 202 placed at a predetermined height H (1.2 m) above the ground and a predetermined distance K (1 m) away from the rear left-side surface of the test vehicle 200. In the test vehicle 200, the fuel pump was disposed behind the rear seat and in the center of left half of the vehicle body.

Figure 18:
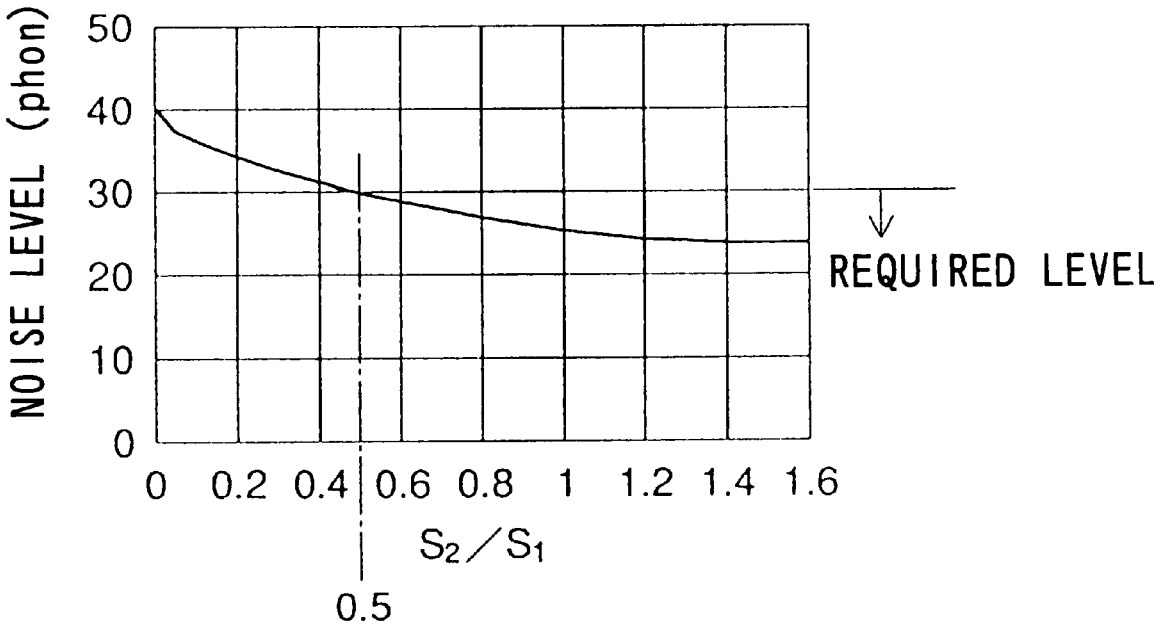
FIG. 18 is a characteristic curve showing the results of measuring noise levels.

The measured results are shown by a characteristic curve in FIG. 18. The ordinate indicates noise level and the abscissa indicates the area ratio $S_2/S_1$. This characteristic curve clearly shows the fact that the larger $S_2$ (the shielding area of the shielding wall 27) becomes relative to $S_1$ (the flow passage area of the inlet port 19), the lower the noise level becomes.

Generally, the noise level for the known fuel pump measured in a similar test was about 40 phons (impeller noise 47 phons). On the other hand, when the noise level reaches about 50 to 60 phons or higher, a person ordinarily starts to feel discomfort. This phenomenon is described, for example, in "Noise & Vibrations (the first volume)," Corona Publishing Co., Compiled by Japanese Acoustics Association, Sep. 20, 1983), page 46, FIG. 2–17, and in "Sound and Sound Waves," Shokabo Publishing Co., Kohashi Yutaka, Apr. 25, 1984 ($14^{th}$ edition), page 201, FIG. 13-3. For the reason described above, most vehicle users do not feel uncomfortable at noise level around 40 phons, but some sensitive people feel uncomfortable even at this level.

In order to satisfy these people, the noise level is preferably restricted to 40 phons at the highest. When taking into account product-by-product variations and population standard deviation 3*a,* the noise level emitted from the vehicle should be restricted to 30 phons or lower. As should be apparent from FIG. 18, the required noise level of 30 phons or lower can be obtained where the equation $S_2/S_1>0.5$ is satisfied. Therefore, the sizes of flow passage area $S_1$ of the inlet port 19 and shielding area $S_2$ of the shielding wall 27 should preferably be determined to satisfy the above equation. As a result of this determination, the noise level emitted from the operating pump is reduced to a level at which most people do not feel uncomfortable.

Embodiment 7

Figure 19:
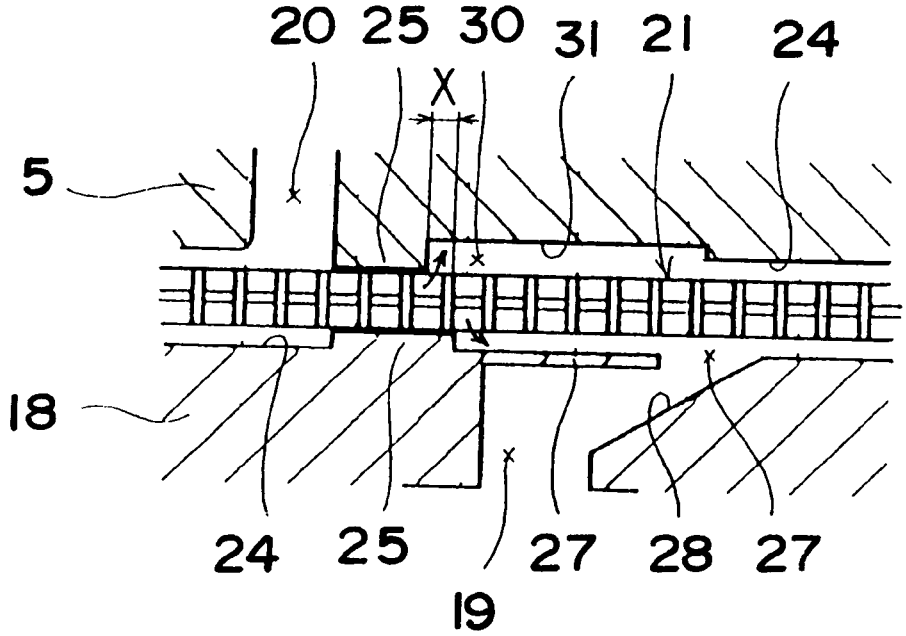
FIG. 19 is a fragmentary sectional view showing a seventh embodiment of the present invention.

Embodiment 7 will be described with reference to FIG. 19 showing a fragmentary sectional view thereof. In Embodiment 7, the recess 31 of the pump cover 5 is formed deeper than the flow channel 24 of Embodiment 1 (see FIG. 2) to thereby increase a volume of the passage-enlarged portion 30. With such a volume increase, decompression of the high-pressure fuel can effectively be achieved.

In addition, a starting edge of the passage-enlarged portion 30 provided axially on the same side of the impeller as the inlet port (left end of the passage-enlarged portion 30 under the impeller 21 in FIG. 19) is offset by distance X from a starting edge of the opposite-side passage-enlarged portion 30 (left end of the passage-enlarged portion 30 above the impeller 21 in FIG. 19) in the direction of the impeller rotation.

According to this embodiment, the high-pressure fuel is decompressed step-wise, first in the opposite-side passage-enlarged portion 30 and then in the inlet-port-side passage-enlarged portion 30. Decompression of the high-pressure fuel is more effectively performed in comparison to the fuel pump in which both of the starting edges of the enlarged portions 30 are axially disposed at the same position in which decompression of the high-pressure fuel begins simultaneously (for example, see FIG. 9 in Embodiment 4). Therefore, the pressure difference between the decompressed fuel and the fuel drawn through the inlet port 19 (having a negative pressure) becomes smaller, thus reducing the fuel colliding force and effectively decreasing pump-operating noise. Also in Embodiment 5 (see FIG. 11), a passage-enlarged portion 30 similar to that of Embodiment 7 can be constructed on the inlet-port-side (under the impeller 21 in FIG. 11).

Embodiment 8

Figure 20:
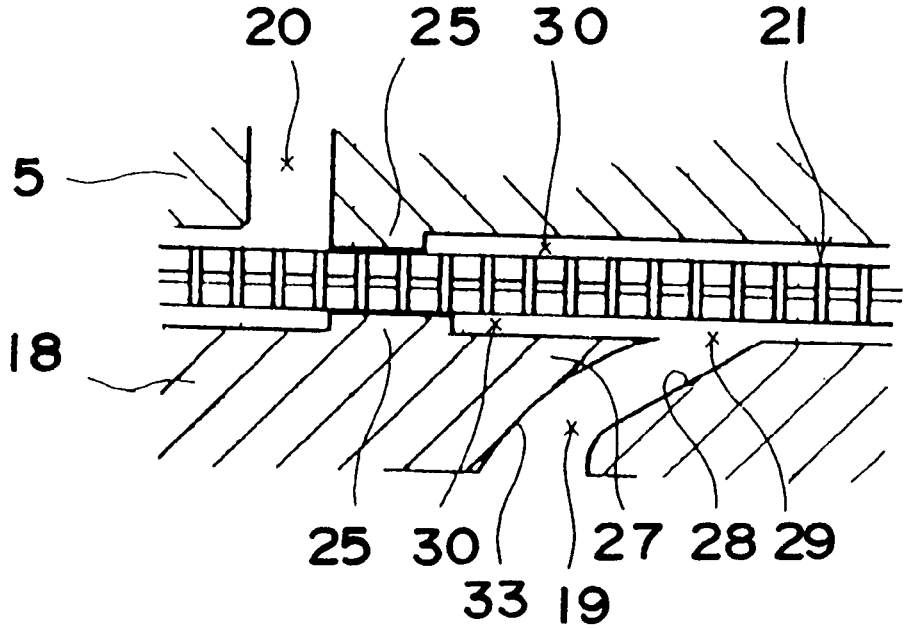
FIG. 20 is a fragmentary sectional view showing a eighth embodiment of the present invention.

Embodiment 8 will be described with reference to FIG. 20 showing a fragmentary sectional view thereof. Embodiment 8 is formed such that the slant surface of the shielding wall 27 of the pump body 18 in Embodiment 2 (see FIG. 6) is replaced with a curved concave surface. The body-side passage-enlarged portion 30 facing the impeller 21 is formed such that the shielding wall 27 is provided to have a stair-step shape relative to the sealing surface of the partition 25. The starting edges of the body-side and cover-side passage-enlarged portions are formed in the same manner as those of Embodiment 7.

Embodiment 9

Figure 21:
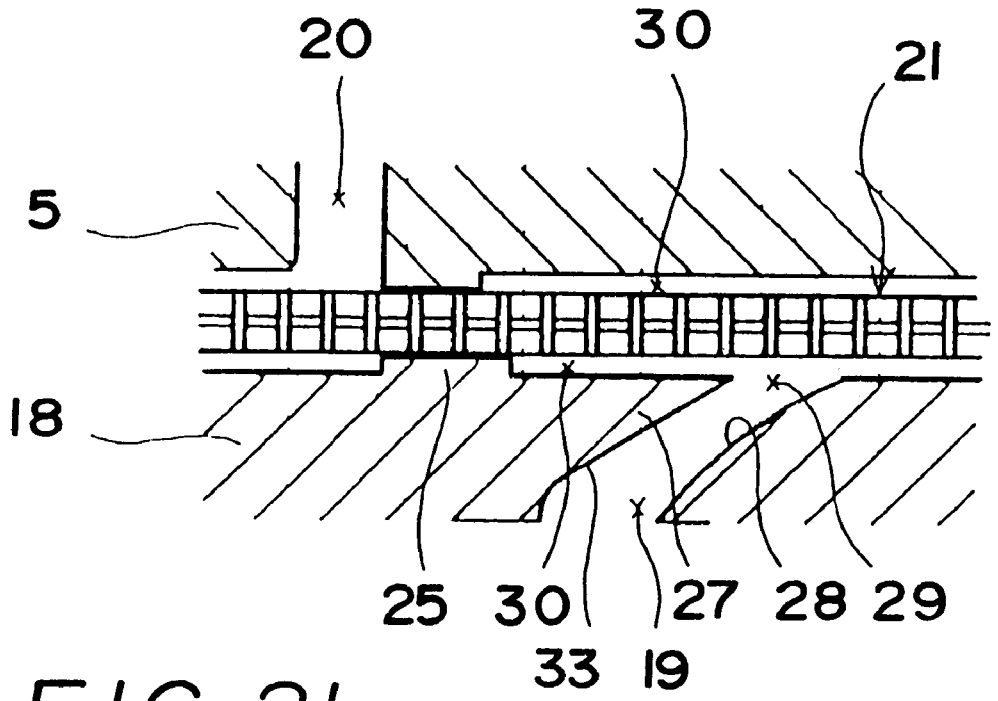
FIG. 21 is a fragmentary sectional view showing a ninth embodiment of the present invention.

Embodiment 9 will be described with reference to FIG. 21 showing a fragmentary sectional view thereof. Embodiment 9 is formed such that the slant surface 28 facing the shielding wall 27 of the pump body 18 in Embodiment 2 (see FIG. 6) is replaced with a curved convex surface. The body-side passage-enlarged portion 30 facing the impeller 21 is formed such that the shielding wall 27 is provided to have a stair-step shape relative to the sealing surface of the partition 25. The starting edges of the body-side and cover-side passage-enlarged portions 30 are formed in the same manner as those of Embodiment 7.

Embodiment 10

Figure 22:
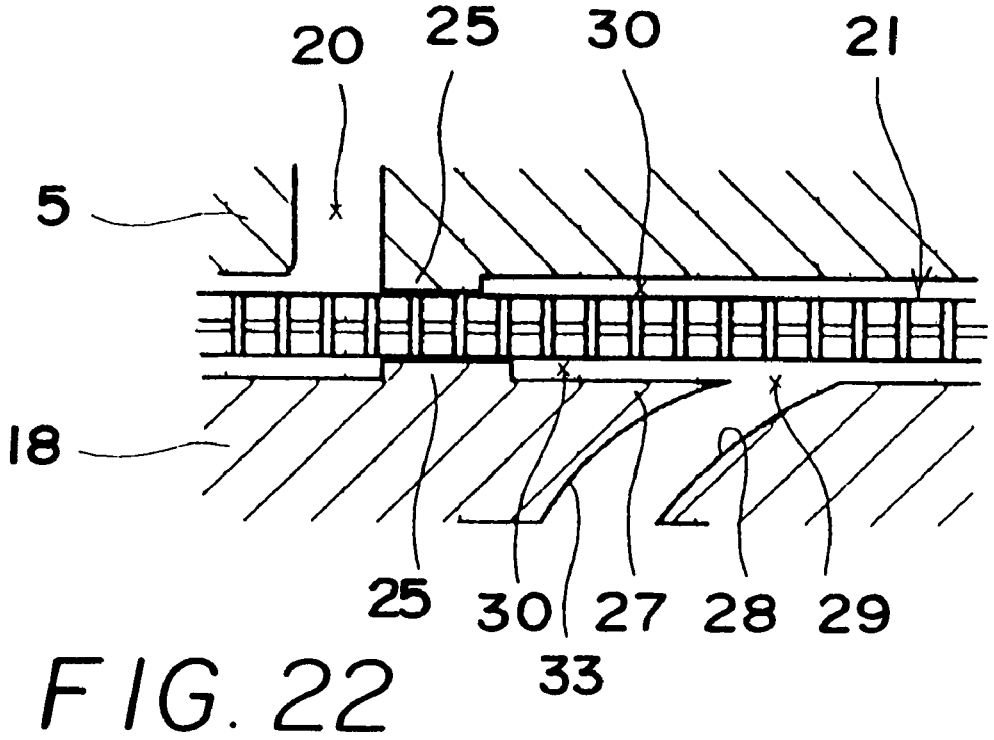
FIG. 22 is a fragmentary sectional view showing the tenth embodiment of the present invention.

Embodiment 10 will be described with reference to FIG. 22 showing a fragmentary sectional view thereof. Embodiment 10 is constructed such that the slant surface 33 of the shielding wall 27 of the pump body 18 in Embodiment 9 (see FIG. 21) is replaced with a curved concave surface. The starting edges of the body-side and cover-side passage-enlarged portions 30 are formed in the same manner as those of Embodiment 7.

Embodiment 11

Figure 23:
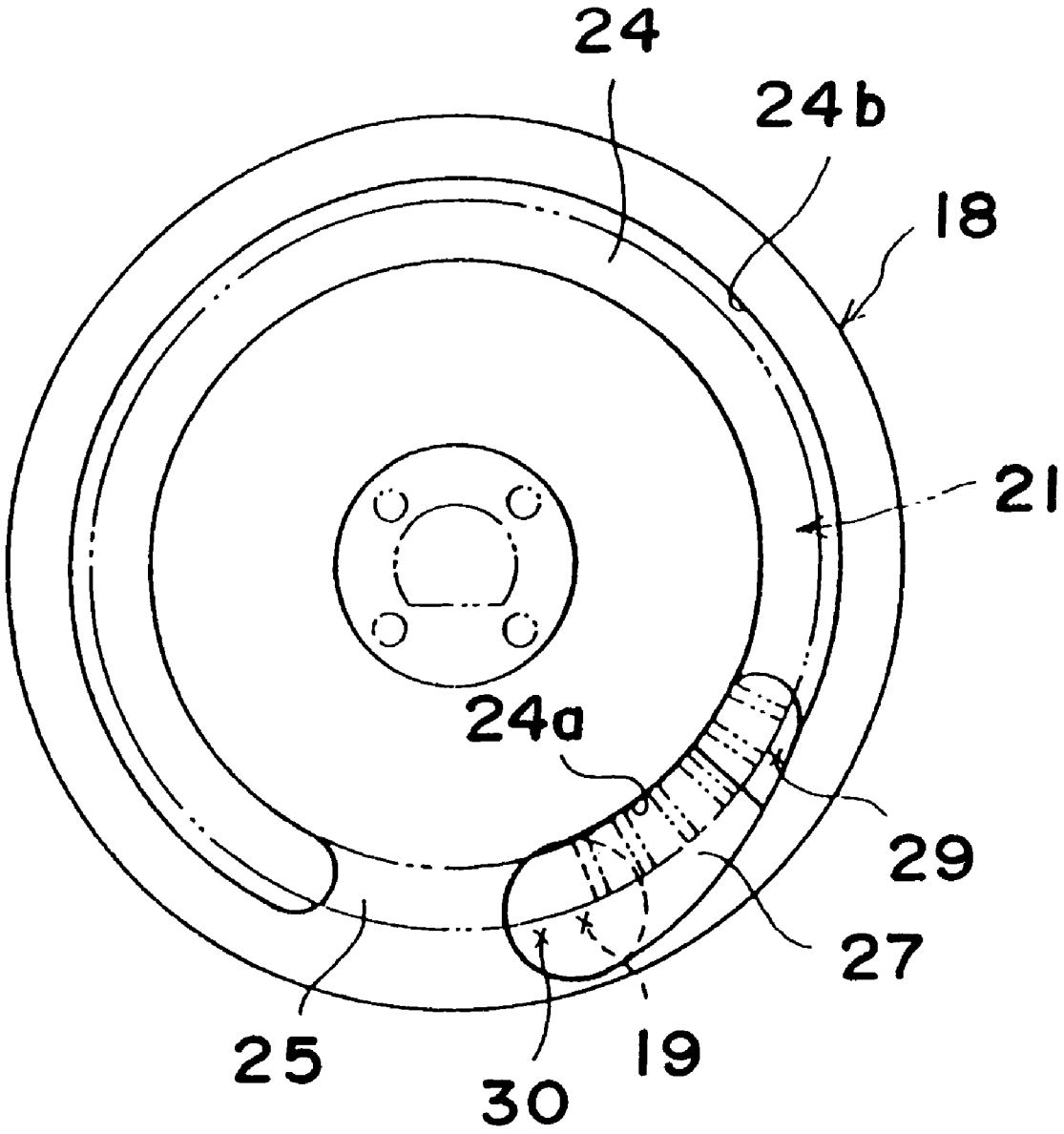
FIG. 23 is a plan view of a pump body showing an eleventh embodiment of the present invention.

Embodiment 11 will be described with reference to FIG. 23 showing a plan view of the pump body 18. Embodiment 11 is formed such that the passage-enlarged portion 30 of Embodiment 1 (see FIG. 3) is arranged at a position radially outside of the inner periphery of the pump passage 23 (or radially outside of the inner periphery of the flow channel 24 as numbered 24*a*).

According to this embodiment, the passage-enlarged portion 30 can be provided without reducing a sealing area of the pump housing PH relative to the impeller 21. (The sealing area of the pump housing PH is the totaled area in which the sealing surfaces of the pump cover 5 and the pump body 18 face the impeller 21.) On the other hand, when the passage-enlarged portion 30 extends radially inward over the inner periphery 24*a* of the flow channel 24 (see Embodiments 1 or 4, for example), the sealing area of the pump housing PH relative to the impeller 21 is decreased, thus decreasing the sealing effect. This disadvantage can be avoided by providing the passage-enlarged portion 30 at the position radially outside of the inner periphery 24*a* of the flow channel 24.

Also, in this embodiment, the passage-enlarged portion 30 is provided, as shown in FIG. 23, to extend radially outward over an outer periphery 24*b* of the flow channel 24, thereby increasing the volume of the passage-enlarged portion 30 and therefore effectively decompressing the high-pressure fuel.

The present invention is not limited to the above-described preferred embodiments and many modifications or variations may be easily made without departing from the scope of the present invention. For example, each of the above-described embodiments exemplifies one-stage fuel pumps that incorporate one impeller 21 therein. However, in a multiple-stage fuel pump having a plurality of impellers 21, the noise reducing effect can be greatly improved by forming the shape of each inlet port 19 as constructed in the present invention. Of the multiple-stage-impellers, the first-stage impeller provides the greatest noise reducing effect.

What is claimed is:

1. A fuel pump including an impeller having vane grooves on an outer circumference thereof and a pump housing surrounding said impeller, said pump housing comprising an inlet port and an outlet port disposed in a spaced-apart relationship from each other in a direction of rotation of said impeller, a pump passage extending along said outer circumference of said impeller from said inlet port to said outlet port in the direction of the impeller rotation, and a partition extending from said outlet port to said inlet port in the direction of the impeller rotation for partitioning said inlet and outlet ports, wherein a shielding wall is formed to have a stair-step shape relative to a sealing surface of said partition axially on the same side of said impeller as said inlet port, said shielding wall extending from said partition to a passage-communicating portion for communication between said inlet port and said pump passage, whereby said passage-communicating portion is offset from said partition in the direction of the impeller rotation, and a passage enlarged-portion that has a flow passage area greater than a flow passage area narrowed by said partition can be formed between said partition and said passage-communicating portion.

2. The fuel pump of claim 1, wherein a wall surface opposite to said shielding wall in said passage-communicating portion is formed to slant upward from said inlet port toward said pump passage in the direction of the impeller rotation.

3. The fuel pump of claim 1, wherein an inlet-port-side wall surface of said shielding wall is formed to slant upward from said inlet port to said passage-communicating portion in the direction of the impeller rotation.

4. The fuel pump of claim 1, wherein the sizes of flow passage area $S_1$ of said inlet port and shielding area $S_2$ of said shielding wall are formed to satisfy the relationship S2/S1>0.5.

5. The fuel pump of claim 1, wherein two passage-enlarged portions are provided such that each portion axially faces each end of said impeller.

6. The fuel pump of claim 5, wherein a starting edge of a passage-enlarged portion axially provided on the same side as said inlet port is offset from a starting edge of a passage-enlarged portion on the opposite side in the direction of the impeller rotation.

7. The fuel pump of claim 5, wherein said passage-enlarged portion is provided at a position radially outside of an inner periphery of said pump passage.

8. A fuel pump including an impeller having vane grooves on an outer circumference thereof and a pump housing surrounding said impeller, said pump housing comprising an inlet port and an outlet port disposed in a spaced-apart relationship from each other in a direction of rotation of said impeller, a pump passage extending along said outer circumference of said impeller to extend from said inlet port to said outlet port in the direction of the impeller rotation, and a partition extending from said outlet port to said inlet port in the direction of the impeller rotation for partitioning said inlet and outlet ports, wherein a shielding wall is formed to be coplanar with a sealing surface of said partition which is axially on the same side of the impeller as said inlet port, said shielding wall extending from said partition to a passage-communicating portion for communication between said inlet port and said pump passage, and a passage enlarged-portion is formed on the opposite side to have a flow passage area greater than a flow passage area narrowed by said partition, and a starting edge of said passage-enlarged portion is offset from said passage-communicating portion in an opposite direction from the rotation of said impeller.

9. The fuel pump of claim 8, wherein a wall surface facing said shielding wall in said passage-communicating portion is formed to slant upward from said inlet port toward said pump passage in the direction of the impeller rotation.

10. The fuel pump of claim 8, wherein an inlet-port-side wall surface of said shielding wall is formed to slant upward from said inlet port to said passage-communicating portion in the direction of the impeller rotation.

11. A fuel pump including an impeller having vane grooves on an outer circumference thereof and a pump housing surrounding said impeller, said pump housing comprising an inlet port and an outlet port disposed in a spaced-apart relationship from each other in a direction of rotation of said impeller, a pump passage extending along said outer circumference of said impeller from said inlet port to said outlet port in the direction of the impeller rotation, and a partition extending from said outlet port to said inlet port in the direction of the impeller rotation for partitioning said inlet and outlet ports, wherein a shielding wall is formed to extend from said partition to a passage-communicating portion for communication between said inlet port and said pump passage, whereby said passage-communicating portion is offset from said partition wall in the direction of the impeller rotation, a passage enlarged-portion which has a flow passage area greater than a flow passage area narrowed by said partition is formed between said partition and said passage-communicating portion, and the sizes of flow passage area $S_1$ of said inlet port and shielding area $S_2$ of said shielding wall can be formed to satisfy the relationship S2/S1>0.5.

* * * * *